US006560435B1

(12) United States Patent
Yamamoto et al.

(10) Patent No.: US 6,560,435 B1
(45) Date of Patent: May 6, 2003

(54) ELECTROPHOTOGRAPHIC IMAGE FORMING DEVICE HAVING PROJECTIONS ON A SURFACE OF AN INTERMEDIATE TRANSFER BODY

(75) Inventors: Masashi Yamamoto, Hitachi (JP); Koichi Niwa, Hitachiohta (JP); Tetsuo Ishikawa, Hitachi (JP); Shinichi Hosaka, Takahagi (JP); Masahiro Nakano, Hitachi (JP); Masahiko Saito, Kitaibaraki (JP); Toru Miyasaka, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/937,855

(22) PCT Filed: Sep. 20, 2000

(86) PCT No.: PCT/JP00/06413

§ 371 (c)(1),
(2), (4) Date: Sep. 28, 2001

(87) PCT Pub. No.: WO01/22174

PCT Pub. Date: Mar. 29, 2001

(51) Int. Cl.[7] ..... G03G 15/01; G03G 15/16
(52) U.S. Cl. ..... 399/302; 399/308
(58) Field of Search ..... 399/302, 308, 399/297

(56) References Cited

U.S. PATENT DOCUMENTS 5,519,475 A * 5/1996 Miyamoto et al. ..... 399/308
5,530,532 A * 6/1996 Iino et al. ..... 399/308
5,745,831 A * 4/1998 Nakazawa et al. ..... 399/302
5,845,186 A * 12/1998 Obu ..... 399/308
5,950,058 A * 9/1999 Kusaba et al. ..... 399/302
6,016,417 A * 1/2000 Katsuno et al. ..... 399/308
6,044,236 A * 3/2000 Katoh et al. ..... 399/302
6,078,775 A * 6/2000 Arai et al. ..... 399/302
6,386,697 B1 * 5/2002 Yamamoto et al.

FOREIGN PATENT DOCUMENTS

| | | | |
|---|---|---|---|
| JP | 8-160763 | * | 6/1996 |
| JP | 9-15987 | * | 1/1997 |
| JP | 11-65318 | * | 3/1999 |
| JP | 11-84893 | * | 3/1999 |
| JP | 11-223999 | * | 8/1999 |

* cited by examiner

*Primary Examiner*—Susan S. Y. Lee
(74) *Attorney, Agent, or Firm*—Antonelli, Terry, Stout & Kraus, LLP

(57) ABSTRACT

An intermediate transfer element has at least one or more elastic layers and a toner releasing layer provided on the surface of the elastic layer and has a surface shape including minute projections up to 60 $\mu$m and at least 20 $\mu$m high. By providing the intermediate transfer element with such projections, easy separation with respect to a poorly separable recording medium, such as thin paper is achieved, and an image free from image defects, such as white speckles.

27 Claims, 6 Drawing Sheets

| MAXIMUM PROJECTION HEIGHT | AC DECHARGE VOLTAGE |
|---|---|
| 20 μm | PEEL NG |
| 40 μm | 3.8~5.3kV |

ELECTROPHOTOGRAPHIC IMAGE FORMING DEVICE HAVING PROJECTIONS ON A SURFACE OF AN INTERMEDIATE TRANSFER BODY

BACKGROUND OF THE INVENTION

The present invention relates to an electro-photographic image forming device; and, in particular, it relates to an electrophotographic image forming device, such as a printer, a copying machine and a fax machine, in which a toner image is transferred to an intermediate transfer means, and the toner image on the intermediate transfer means is then transferred onto a recording medium. Further, the invention relates to an intermediate transfer element and an electrophotographic image forming method.

An electrophotographic image forming device operates to form a latent image on a photosensitive body, to develop the latent image on the photosensitive body and to transfer the developed image onto a recording medium, such as paper. Further, it is well known that, when transferring the developed image to the recording medium, an intermediate transfer element (an intermediate transfer means) is employed. Namely, before, transferring the toner image, that has been formed on the photosensitive body, onto the recording medium, the toner image is first transferred onto the intermediate transfer means, and, thereafter, the toner image on the intermediate transfer means is transferred onto the recording medium to form a picture image. In particular, because a multi-color picture image can be easily formed with this type of operation, an intermediate transfer element is used for a color picture image forming device, such as color copying machine and a color printer.

There are a variety of advantages in the use of such an intermediate transfer element. In particular, if an elastic layer is provided on the intermediate transfer element, possible damage to a photosensitive body can be reduced, which damage can be caused when carriers of developing agent are caught at a nip portion of the photosensitive body, so that this technique is effective for prolonging the life of the photosensitive body. JP-A-8-160763 (1996) discloses such an intermediate transfer body. Further, JP-A-9-15987 (1997) proposes to use a belt-shaped delivering means for delivering the recording medium and to provide projections of 1–6 mm at the bottom side of the belt for separating the recording medium.

In the present day, the rigidity of the paper used as a recording medium tends to be weak and the radius of curvature of the drum which the paper contacts tends to larger. For this reason, separation of the paper from an intermediate transfer drum becomes difficult when paper having a weak rigidity is used, with the result that the paper may wind around the intermediate transfer drum so as to cause an undesirable jamming.

In particular, thin papers tend to be used these days in view of environmental considerations and conservation of natural resources, and so there is a strong demand that even paper having a low rigidity have the quality of being easily separated. With regard to the size of paper sheets, as the size of the paper sheets increases, the radius of the intermediate transfer body (an intermediate transfer drum) increases, which makes separation of the paper sheets difficult and resultantly limits the size and kinds of the paper sheets that can be used. Further, with regard to the direction of delivering of the paper sheets, since the rigidity of the paper sheets in the lateral direction with regard to the paper making direction is small, the direction of delivering of the paper sheets is also restricted.

On the one hand, a variety of paper separation measures have been proposed. However, there are few measures which can be employed in practical use. For example, with a measure in which decharging is performed after transference, such as by an AC charger, to remove transferred electric charges and to reduce the adsorption force of the recording medium, such as paper, to the intermediate transfer body, when the removal of the adsorption force is insufficient, the paper separation is achieved primarily by the rigidity of the paper and the curvature of the drum.

A variety of mechanical separation methods are also known, such as catching the top edge of the paper with a claw-shaped member, and separating the paper from the back face thereof by making use of a vacuum adsorption and adhesive member, for example. However, a sufficient performance can not be obtained using such measures, because, for example, with regard to a drum shaped intermediate transfer body, since the recording medium, such as paper, electrostatically adsorbs to the drum in response to a transfer voltage, the provision of another separating means is required.

Further, with one of the mechanical separation methods, involving catching the top edge of the paper sheet with a claw-shaped member, if no separation (clearance) between the top edge of the paper sheet and the intermediate transfer body is present, the claw-shaped member can not catch the paper, so that again, it is difficult to separate a sheet of paper having low rigidity. If a claw-shaped separation mechanism is provided while limiting the kind of paper, the size of the printable region of a picture image at the top edge portion of the paper is limited, because the top edge of the paper sheet is to be caught by the claw-shaped member.

Further, an additional inconvenience may be caused in that the separation claw member may touch the picture image region, such as on the intermediate transfer body and the paper sheet, and disturb the toner image, whereby unneeded toner that adheres on the separation claw-shaped member may contaminate the face of the paper sheet or the separation claw-shaped member may touch the intermediate transfer body so as to damage the surface of the intermediate transfer body.

Still further, with the other mechanical separation method, by separating the paper from the back face thereof using such techniques as vacuum adsorption and an adhesive member, it is extremely difficult to provide a mechanism which achieves a stable separation performance for a variety of kinds of paper during the life of the machine. Further, such a separation mechanism requires a complex structure which raises the cost thereof and makes the machine less desirable for practical use.

An object of the present invention is to enable printing even under poorly separable condition in which it is difficult to separate the paper from the intermediate transfer body. More specifically, an object of the present invention is to provide an image forming device in which an intermediate transfer body having a simple structure and a low cost can be realized, and which is free from such restrictions as small rigidity of thin paper, the size of the paper and the paper making direction, and which exhibits a stable paper sheet separation performance for a long life time.

SUMMARY OF THE INVENTION

In order to achieve the foregoing objects, in an image forming device of the present invention in which a toner image on a photosensitive body is transferred onto an intermediate transfer means and the toner image on the intermediate transfer means is further transferred onto a recording medium, minute projections having a height of more than 20 μm, but less than 60 μm, are provided on the surface of the intermediate transfer means.

BRIEF DESCRIPTION OF THE DRAWINGS

FIG. 3(*b*) is a graph showing the height and width of a projection when measuring the shape of projections on the surface of the transfer drum according to an embodiment of the present invention;

BEST MODES FOR PRACTICING THE INVENTION

Hereinbelow, the present invention will be described with reference to a color image forming device according to an embodiment of the present invention.

Figure 1:
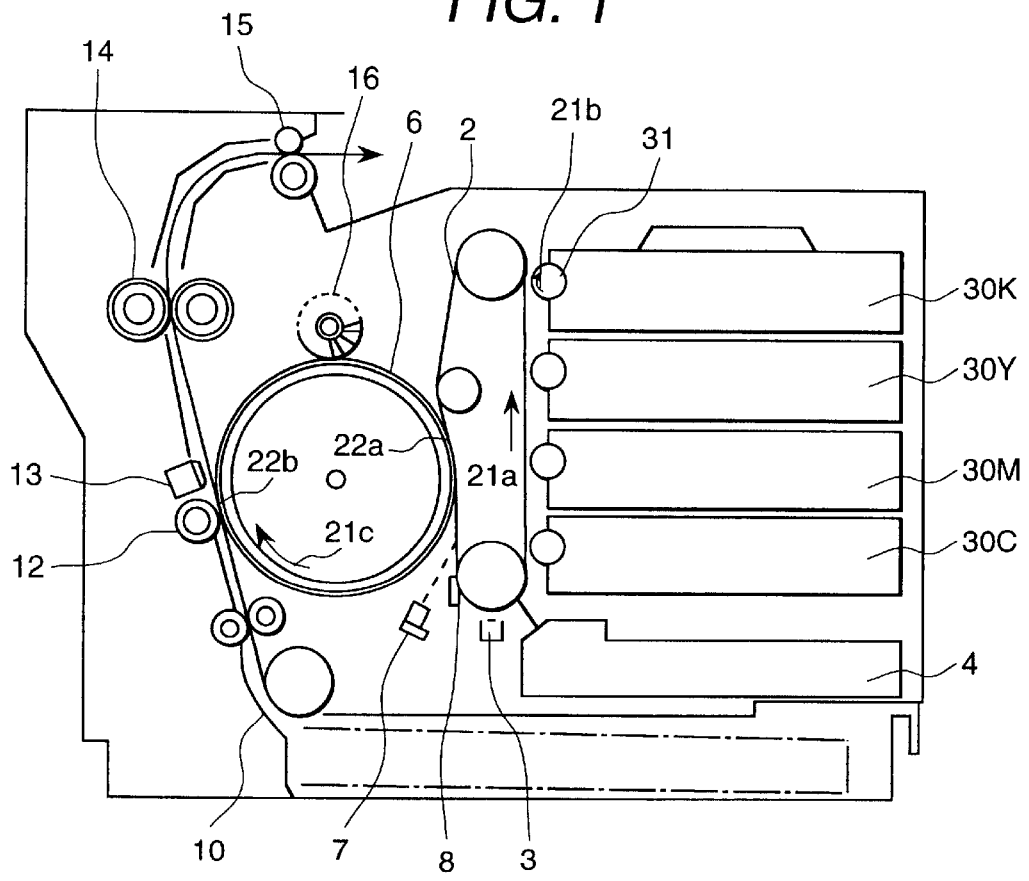
FIG. 1 is a vertical cross sectional view of a color image forming device according to an embodiment of the present invention.

FIG. 1 is a cross sectional view of a small sized color image forming device according to an embodiment of the present invention.

In the main body constituted by a machine frame body (outer frame) 1 of the color image forming device, a photosensitive body (photosensitive belt 2) serving as a latent image holding means is disposed in a vertical direction forming an elongated path. With the frame 1 being divided by the photosensitive belt 2, on the left side there are a transfer drum 6 serving as an intermediate transfer body (intermediate transfer means), a transfer device (a transfer means) 12, a feeding device 10 for feeding recording medium, and a fixing unit (fixing means) 14. On the right side of the photosensitive belt 2, there are four developing devices (developing means) 30Y, 30M, 30C and 30K, in each of which a respective one of four toners having four different colors is charged.

The transfer drum 6 serving as an intermediate transfer body is required to have an outer circumferential length that is longer than the length of the concerned paper sheet size; therefore, in the image forming device of the present embodiment, which accommodates a paper sheet of A3 size, the outer circumferential length of the transfer drum 6 is required to be longer than 420 mm, which corresponds to the longitudinal length of an A3 size paper sheet. In addition to the requirement to meet the longitudinal length of an A3 size sheet, in order to provide smooth feeding of paper sheets between successive paper sheets and to ensure that there is an interval between sheets, a drum having a diameter of 162.2 mm is used for the transfer drum 6 in the image forming device of the present embodiment.

Below the bottom portion of the developing device 30C, an exposure device 4 is provided for forming a latent image on the photosensitive belt 2. Around the transfer drum 6, there are the transfer device 12, a recording medium separation device 13 and an intermediate transfer body cleaning device 16; and, around the photosensitive belt 2, an electric charging device 3, a residual image removing device 7 and a photosensitive body cleaning device 8 are disposed.

The photosensitive belt 2, serving as the latent image holding means, is driven in the direction of the arrow 21*a* by a drive device (not shown). Then, at first, a photosensitive layer on the surface of the driven photosensitive belt 2 is uniformly charged by the electrostatic charging device 3. Subsequently, an image or character information, specified by a source, such as a personal computer or an image scanner, is exposed in dot units by the exposure device 4 to form an electrostatic latent image on the photosensitive belt 2. Thereafter, the electrostatic latent image on the photosensitive belt 2 is developed by one of the developing devices 30Y, 30M, 30C and 30K into a visible toner image, and the toner image is set to a first transfer position 22*a*. The photosensitive belt 2 is provided with a predetermined electrical potential from a power source (not shown), and transfer drum 6 is connected to the earth. For this reason, because of the potential difference, transfer of the toner image from the photosensitive belt 2 to the transfer drum 6 is performed at the first transfer position 22*a*.

After passing through the first transfer position 22*a*, the electrostatic latent image on the photosensitive belt 2 is erased through light irradiation by the residual image removing device 7, and the surface electric potential of the photosensitive belt 2 is dropped below a predetermined level. Thereafter, the remaining toner on the photosensitive belt 2, which was not transferred at the first transference, is removed by the photosensitive body cleaning device 8 to create a condition which permits subsequent toner image formation.

When the above-described one cycle of operation is performed successively in synchronism with one rotation of the transfer drum 6 for each of the respective developing devices 30Y, 30M 30C and 30K, a toner image of a plurality of colors is formed on the transfer drum 6 by overlapping respective single color toner images.

Subsequently, the recording medium, such as a paper sheet or OHP sheet, is timely fed to a second transfer position 22*b* by the feeding device 10, and a single color or a multicolor toner image formed on the transfer drum 6 is transferred onto the recording medium by means of the transfer device 12.

After transferring the toner image onto the recording medium, the recording medium is separated from the transfer drum 6 by the record medium separation device 13, the toner is melted and fixed on the recording medium by the fixing unit 14 and the recording medium is discharged by a paper discharging device onto the upper face of the main body. On the other hand, the toner which remains on the transfer drum 6 after completing the image transfer onto the recording medium is removed by the intermediate transfer body cleaning device 16 to create a condition which permits subsequent toner image overlapping.

In the present embodiment, the record medium delivering route is arranged approximately in an arcuate shape, and by disposing such elements as the transfer drum 6, the photosensitive belt 2, the developers 30Y, 30M, 30C and 30K and the exposure device 4 inside the record medium delivering route, the internal space of the main body is effectively used so as to reduce the size thereof. In addition, the delivering route is simplified, and it is constituted such that, when the record medium is discharged, the printed surface thereof faces downward.

With the above-described arrangement, almost all of the units are disposed in the main body inside the delivering route, so that the delivering route can be located near the machine frame body (outer frame). As a result, the delivering route can be easily accessed, which facilitates the maintenance needed to eliminate a paper jam. Further, by delivering the record medium with the printed surface thereof facing downward, an advantage is attained in that the recording medium is successively delivered in the order of printing.

Through the use of a belt-shaped photosensitive body, a plurality of developers 30 having substantially the same shape for a plurality of colors can be arranged along a common plane parallel to the photosensitive belt. Therefore, neither a mechanism for exchanging developers depending on the color to be developed, nor modification of the developer shape depending on the colors, are required, so that the size of the developers can be reduced, as well as the cost thereof. Further, since the space occupied by the photosensitive belt can be limited, the size of the main body can also be reduced.

When the record medium is delivered from the bottom portion of the main body toward the upper portion thereof, the transfer drum 6 rotates in the direction of the arrow 21*c* and the photosensitive belt 2 rotates in the direction of the arrow 21*a*. Thus, an operation in a forward direction is performed at respective contacting points, whereby a structure which enhances the developing efficiency and limits problems, such as noise, can be obtained. Further, the transfer drum 6 can be formed to operate as a follower with respect to the photosensitive belt 2, whereby a structure which limits color dislocation can be constituted. In this instance, through the use of a reverse rotation developing method (a rotating method at the side of the photosensitive belt rotating from the bottom upward) in which toner carrier bodies 31 rotate in the is direction of an arrow 21*b*, the photosensitive belt 2 and the carrier bodies 31 can be operated in the forward direction, whereby a structure which enhances the developing efficiency and limits problems, such as noise, can be obtained. The intermediate transfer drum 6 of sufficient size to allow a so-called A3 size paper sheet (which accommodates the longitudinal size of an A3 paper sheet) to wind around the surface thereof in the paper passing direction.

The transfer drum 6 is constituted in such a manner that a layer 6*b* having rubber elasticity is formed on a conductive cylindrical base body (for example, aluminum drum) 6*a*, and a surface layer 6*c* is formed on the layer 6*b*. The surface layer 6*b* is desired to have an excellent releasing property with regard to toner in order to perform a desirable transfer of a toner image from the transfer drum 6*a* to the record medium at the second transfer position 22*b*. Thus, the surface layer 6*b* is constituted, for example, by a layer including fluoro rubber as the base body; and, further, in order to further enhance the releasing property, it is preferable to mix a fluoro resin component therein. Further, in order to enhance the releasability with regard to toner powders, a material such as hydrophobic silica can be anchored, adhered or dispersed on the surface of the surface layer 6*c*.

Figure 3A:
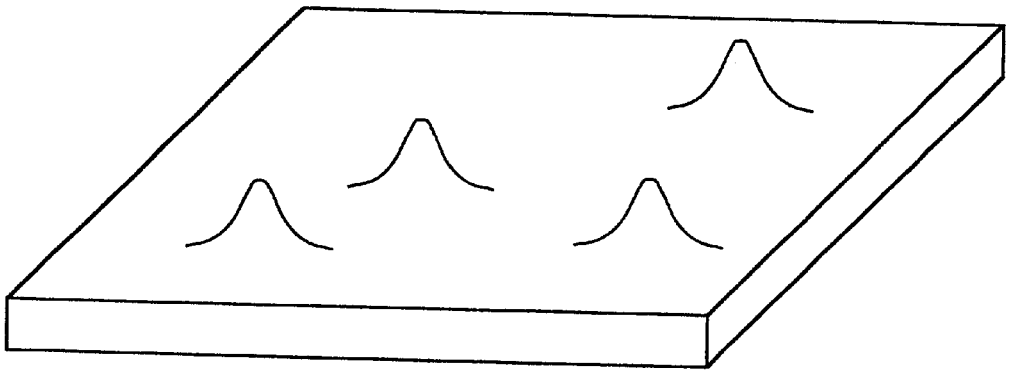
FIG. 3(*a*) is a diagram illustrating a surface having projections.
Figure 3B:
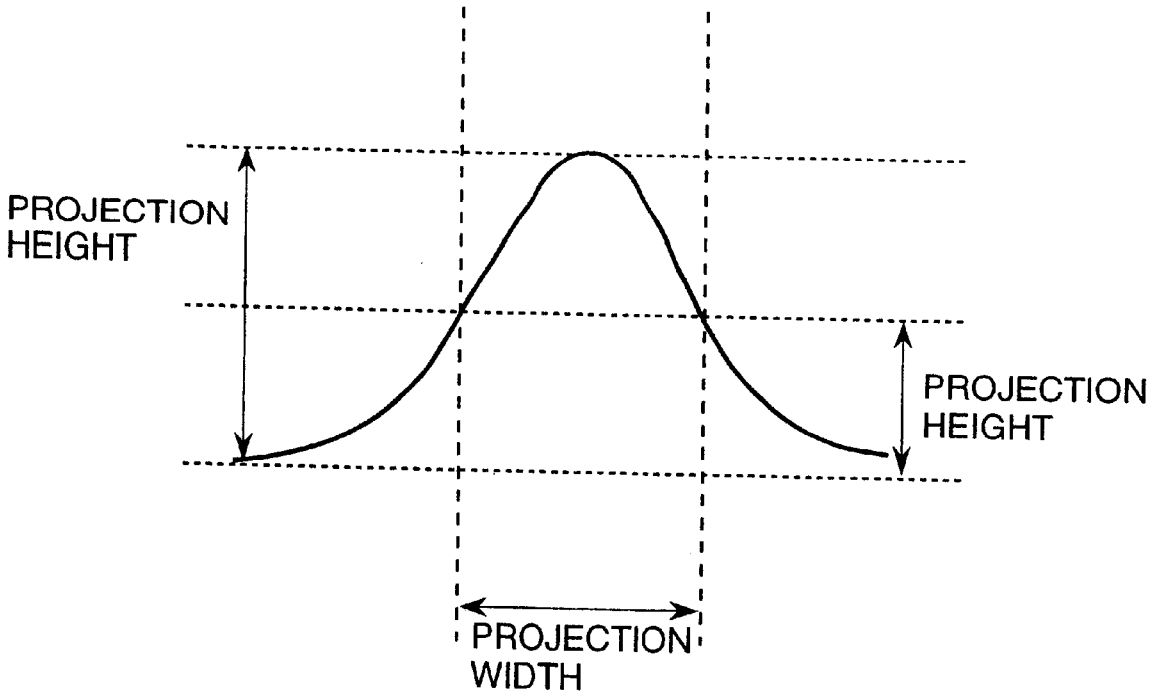

On the surface of the surface layer 6*c*, minute projections having a height more than 20 $\mu$m and less than 60 $\mu$m are provided (more specifically, it is sufficient, if more than 90% of the projections have a height less than 60 $\mu$m and more than 30% of the projections have a height more than 20 $\mu$m. A measurement result of height distribution of the minute projections in the present embodiment is shown in FIGS. 3(*a*) and 3(*b*). The height of the projections was measured, without performing averaging processing of their unevenness in size, such as the height and width of such minute configurations, by a surface configuration measurement device, which can directly numerize the projections as well as measure a specific portion on the surface, for example, a surface configuration around the apex of a minute projection. For example, in the present embodiment, a laser electron microscope VF-7510 of Keyens Co. having minimum measurement resolution of 0.01 $\mu$m was used. The width of the projections provided on the surface of the transfer drum 6 in the present embodiment is in a range of several tens $\mu$m—several hundreds $\mu$m, the states of the projections on the surface can be observed by a magnification of several tens—several hundreds times with the above-referenced laser electron microscope. With a magnification of about 1000 times, the configuration, such as the height and the width of respective projections on the surface of the transfer drum 6, can be observed. How the height and width of the projections were observed will be explained specifically. FIG. 3(*b*) shows a configuration profile of a single projection, which was obtained when the surface of the transfer drum 6 was observed with the above-mentioned laser electron microscope. The height of the projection is defined by the length of a vertical line passing through the apex of the projection and crossing a line connecting the lowest points of the projection, and the width of the projection is defined by the width at a standard height from the line connecting the lower most points of the projection.

Of course, in order to enhance the measurement efficiency, using a measurement apparatus which makes it possible to display, three dimensionally, a surface configuration of a broad area in a short time, such as a three dimensional configuration measurement apparatus of the type now broadly used, accurate heights of respective projections can be obtained.

The reasons why such measurement method is used in accordance with the present invention are that the separation property of paper sheets, which will be explained later, and the transference property of the toner are greatly affected by the height of the respective projections. With conventional surface configuration measurement methods of the type that are generally used, for example, a measurement method in which the measurement surface is traced with a probe needle that can measure microscopic displacement and a non-contact type range finder which uses a laser, since the traced portions necessarily pass the apexes of the projections, the possible existence of an extremely large projection can be overlooked.

During a first observation time, the present inventors observed the configuration of a surface using the conventional surface configuration measurement methods of the type that are generally used, for example, the measurement method in which the measurement surface is traced with a probe needle that can measure microscopic displacement and the non-contact type range finder which uses a laser. However, with such measurement methods in which the measurement surface is traced, since the traced portions necessarily pass the apexes of the projections, the existence of extremely large projections were overlooked. Since an extremely large projection is a cause by itself to induce an image defect, therefore, even if there are only a few such projections on the surface of the transfer drum 6, the image quality will be deteriorated. For this reason, it is important to use a measurement apparatus, such as a laser electron microscope, which makes it possible to measure the configuration of projections, while observing respective projections. It was conventionally understood that, with regard to the height of the projections, if the height of such unevenness is less than 20 $\mu$m, the toner transfer can be performed desirably; however, if there is a projection higher than 20$\mu$, because of such projection, the necessary close contact at the transfer position becomes insufficient, a microscopic gap is caused between the toner carrier and the body to which the toner is transferred, and the toner transfer around the projection becomes insufficient, with the result that an image defect of white speckles appears. However, according to our study, we have found that even if there are projections having a height more than 20 $\mu$m (and less than 60 $\mu$m), if the projections are formed on an elastic layer, such projections never cause image defects, such as white speckles. When a transfer drum having a projection height distribution (a) in FIG. 4 was used and a solid printing was performed over the entire surface of the present invention, an image with an extremely low quality was obtained in which the projection portions exhibited the presence of white speckles. However, when a transfer drum having the projection height distribution (b) in FIG. 4 was used, an image having a stable image quality with no speckles was obtained. Namely, when the projections are formed on an elastic layer and the projection height is less than 60 $\mu$m at the transfer position due to elastic deformation of the elastic layer, it is considered that a sufficient close contacting property for transferring toner can be obtained, and a desirable image can be obtained. Of course, if there are minute projections having a height less than 20 $\mu$m, as in the case of a drum having a projection height distribution (c) in FIG. 4, no white speckles appear and no adverse effect to the image is caused. On the other hand, if the projection height exceeds 60 $\mu$m, the image quality deteriorates, and therefore, more preferably, it is desirable to limit the projection height to less than 40 $\mu$m, in view of mass production of the machine.

Of course, with regard to a projection height which prevents generation of image defects, since the degree of elastic deformation of the projections and the elastic layer varies depending on the thickness and hardness of the elastic layer being used and the material of the projections, it will be apparent that, even if the projection height exceeds 60 $\mu$m, image defects may be avoided if the deformation amount is enlarged by reducing the hardness of one or both and by increasing the thickness of the elastic layer. In the present embodiment, in which the projections are provided on a solid rubber layer, it is preferable to limit the maximum projection height to about 60 $\mu$m.

Figures 4, 5:
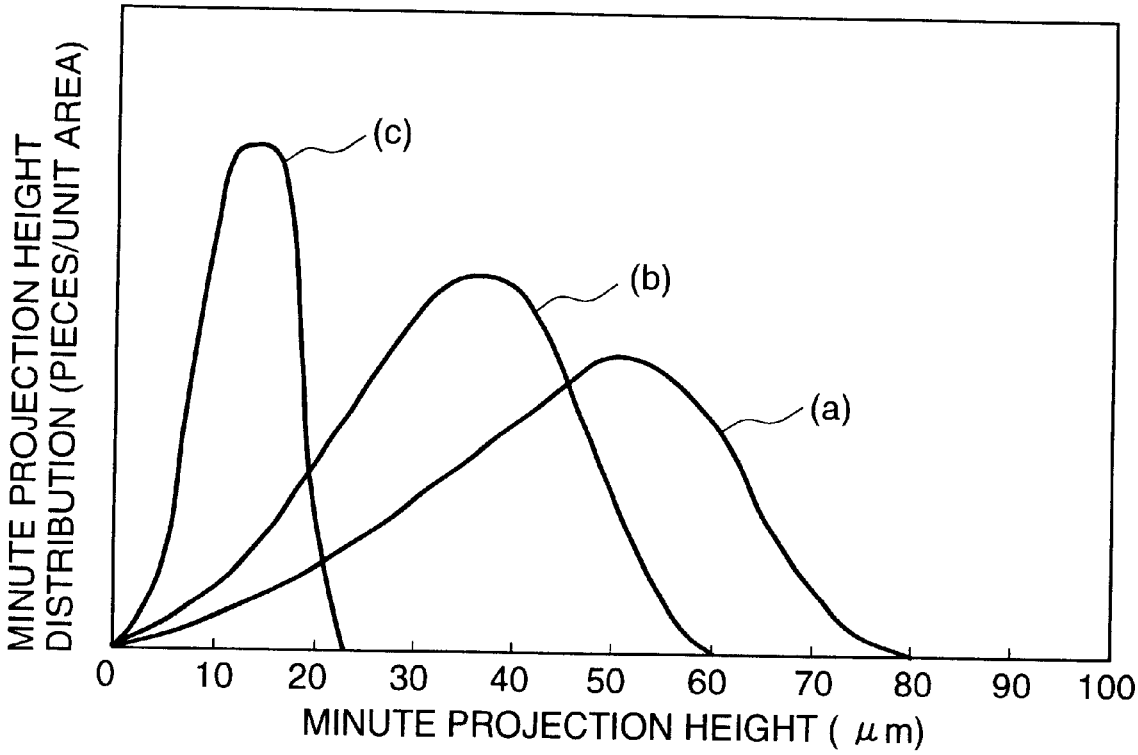
FIG. 4 is a graph showing the height distribution of the minute projections according to an embodiment of the present invention.
FIG. 5 is a table showing a test result of paper sheet separation performance according to an embodiment of the present invention.

Further, a test result of paper separation in the present embodiment is shown in FIG. 5. For the test, an S paper of Xerox Co. having 62 g/m$^2$, a so-called thin paper, was used. After the toner is transferred at the second transfer position 22*b*, since the paper sheet of record medium closely contacts the transfer drum 6 through electrostatic adsorption, separation is performed by the record medium separation device 13; however, in the present embodiment, decharging is performed by an AC decharger serving as the record medium separation device 13. Since the transfer means 12 provides transfer electric charges of an opposite polarity from that of the toner at the back surface of the paper sheet so as to transfer the toner onto the paper sheet, the paper sheet is electrostatically adsorbed onto the transfer drum 6 by means of the transfer electric charges. The record medium separation device 13 weakens the adsorption force by reducing the transfer electric charges and helps the paper sheet to separate from the transfer drum 6 by its own rigidity.

FIG. 5 shows a paper separation property of the AC decharger with respect to the decharge voltage. The paper separation method which makes use of AC decharging is simple with regard to the structure thereof and is operable in a non-contact manner with respect to the record medium, thereby, the method can be realized at a low cost without causing image defects. However, the paper separation after the decharging is effected by the rigidity of the paper itself, which is aided by the curvature of the drum, so that there is a drawback in that the separation is difficult for a thin paper sheet having a low rigidity. In particular, in case the paper making direction is transverse with respect to the paper sheet passing direction (lateral paper making direction), the paper exhibits a small rigidity in comparison with a case in which the paper making direction is in parallel with the paper sheet passing direction (longitudinal paper making direction). Further, when the top edge of a paper sheet is deformed in the curvature direction of the drum, the paper separation property is extremely reduced. However, when minute projections having a height more than 20 $\mu$m are provided on the surface of the transfer drum 6, as employed in the present embodiment, even in a case where the paper is thin, the paper making direction is in the lateral direction and the top edge of the paper sheet is deformed in the circumferential direction of the drum, it has been found that a desirable paper sheet separation property can be obtained with an extremely broad range of AC decharging voltages. This is because, since the minute projections cause gaps to form between the paper sheet and the surface of the transfer drum 6, the electrostatic adsorption force through which the paper sheet adsorbs to the transfer drum 6 is reduced.

Of course, when a paper separation method is employed in which the paper sheet is separated by the rigidity thereof, while performing a decharging of the paper sheet, as in the image forming device of the present embodiment, the projection height necessary for separating the paper sheet is determined by the diameter of the transfer drum 6 being used. Therefore, in the case of a transfer drum having a diameter of 162 mm, which is applicable to an A3 size paper sheet used in the. present embodiment, the necessary projection height is more than 20 $\mu$m; however, if the device is constituted so as to be applicable to a paper sheet which is less than the A4 size, the diameter of the transfer drum of about 110 mm is sufficient. In such an instance, since the paper separation effect produced by the rigidity of the paper sheet increases, it is apparent that the necessary projection height can be set low. According to the results of our study, when the diameter of the transfer drum is set at 110 mm, if the projection height is more than 12 $\mu$m the required paper separation property can be ensured. As will be understood from the above, although the projection height necessary for separating a paper sheet varies depending on the diameter of the transfer drum, since the image forming device of the present embodiment is applied to paper sheets of A3 size, a projection height of more than 20 $\mu$m is necessary.

Figure 6A:
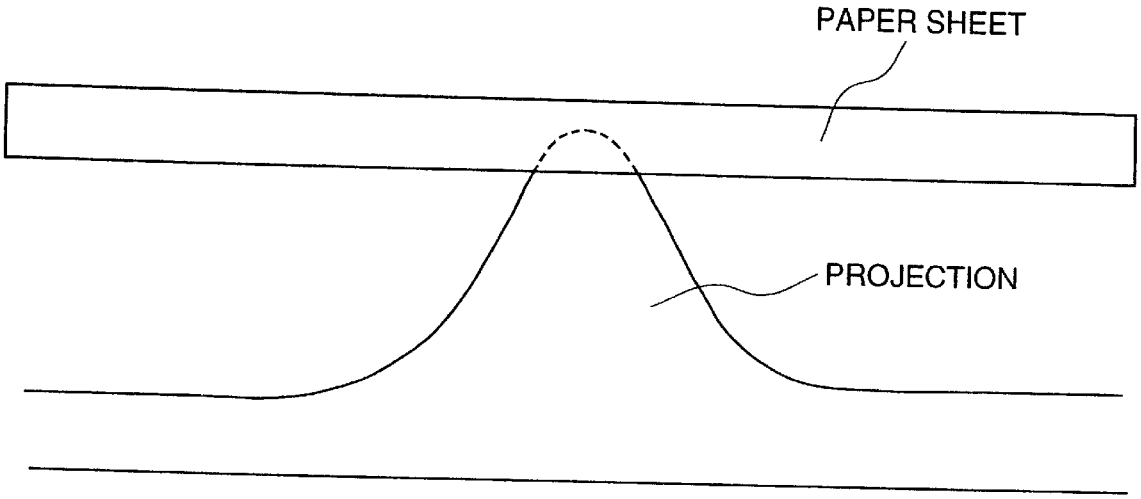
FIG. 6(*a*) is a diagram illustrating the volume of a top portion of a projection on the surface of the transfer drum, and FIG. 6(*b*) is a projective view of the transfer drum surface according to an embodiment of the present invention.
Figure 6B:
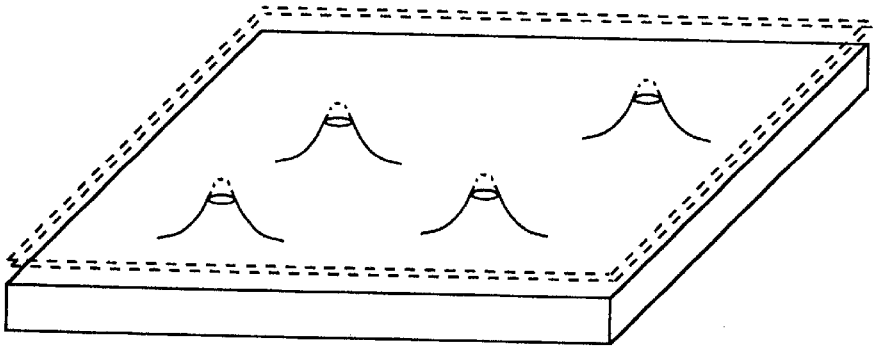

Now, since the pressure which acts on the top end portion of the projection, when the projection contacts the paper sheet, is larger than at other portions, the toner deposited at the top end portion of the projections aggregates due to pressure during the toner transfer, depending on such factors as the powder diameter of the toner, the aggregation property thereof and the moisture absorption state thereof, with the result that toner transfer gaps can be created. In order to prevent the occurrence of such toner transfer gaps, it is effective to reduce the area of the portion where the projection contacts the paper sheet. More specifically, it is effective to limit the area of the portion where the projection contacts the sheet, when pressure is applied during the toner transfer, to below 0.01 mm$^2$, which is visibly unconformable. FIGS. 6(*a*) and 6(*b*) show the shape of a projection when the projection top end portion contacts the paper sheet. The portions shown by dotted lines in the drawing show areas where the projections contact the paper sheet. When the areas shown by dotted lines in the drawing, in which the paper sheet presses the projections to deform the same, become narrower, the toner transfer gaps become unremarkable. As for the configuration of the projections, a post shape, for example, a column shape having a cross section less than 0.01 mm$^2$, is preferable. However, the projection is very small, and so an angle shape is also satisfactory. Since the shape of the projections formed on the surface of the transfer drum 6 in the image forming device of the present embodiment is not a post shape, because of the method of manufacturing the projections, but is a circular angle shape having a height of 40–60 $\mu$m and an average width of 40 $\mu$m at the height of 40 $\mu$m, the area of contact of the projection with the paper sheet at the time of transfer is about 0.0012 mm$^2$, and the above-described toner transfer gaps are kept to an unremarkable level, regardless to the kinds of toner used.

Further, with regard to the paper separation property, the rate of the projecting portions, in the form of a projection, which occupy the entire area (the meaningful area is the printing surface) of the surface of transfer drum, is important. The paper sheet separation property is enhanced with an increase in the gap formed between the surface of the transfer drum and the paper sheet as produced by these projections under the condition that the paper sheet closely contacts the surface of the transfer drum 6. Accordingly, if the number of projections excessively increases, the gap undesirably decreases, and the paper sheet separation property lowers. According to the results of our study using the transfer drum 6 of the present embodiment, the rate of the projecting portions which occupy the entire area of the surface of the transfer drum 6, which is necessary for ensuring a satisfactory paper separation property, is in a range of about 0.1–50%, preferably in a range of about 1–30%. In the image forming device of the present embodiment, the average contacting area of a projection with a paper sheet is 0.0012 mm$^2$, and the number of projections is several thousands–25,000/cm$^2$, therefore, the rate of the area occupied the projections is 1.25–31%.

Of course, if the rate of the projecting portion that occupy the entire area of the surface of the transfer drum 6 is about 0.1–50%, preferably about 1–30%, a variety of combinations with regard to the number of projections and the contact area of a unit projection with the paper sheet can be obtained. With the material used in the present embodiment, in order to form a projection having a height more than 20 $\mu$m, a cross section of at least 0.0002 mm$^2$ was necessary. When using such projections, it is necessary to limit the number of projections to less than 250,000/cm$^2$. Further, when a large projection having a contact area between the projection and the paper sheet of about 0.1 mm$^2$ is used, such projections have to be distributed at a rate of at least 1/cm$^2$.

Figure 7A:
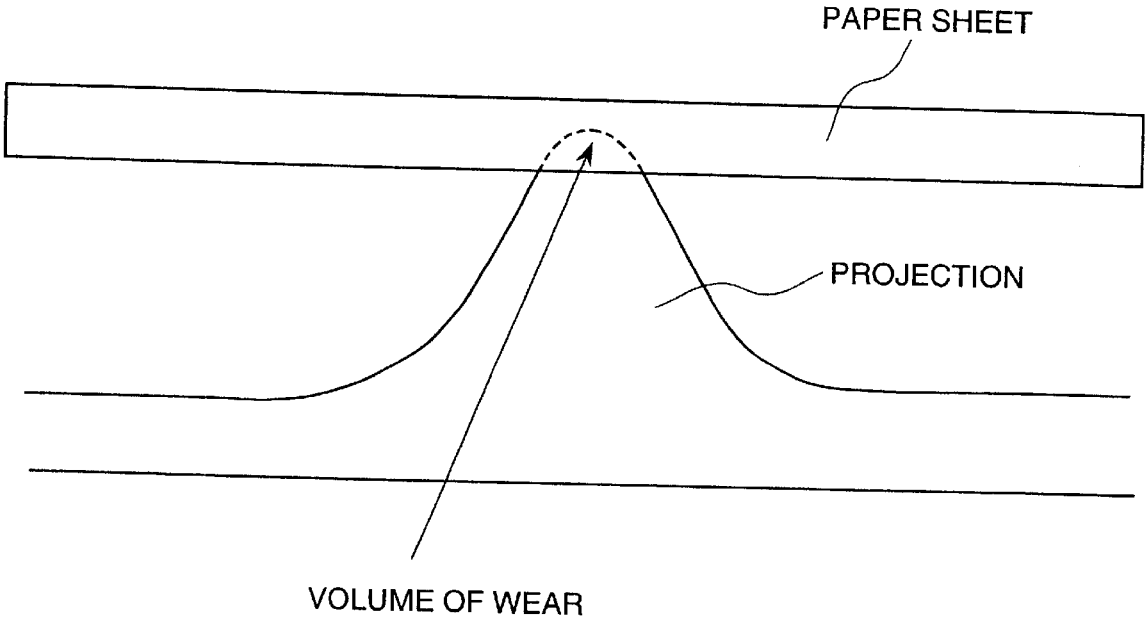
FIG. 7(*a*) is a diagram illustrating the volume of a projection on the surface of the transfer drum, and FIG. 7(*b*) is a perspective view of the transfer drum surface according to an embodiment of the present invention.
Figure 7B:
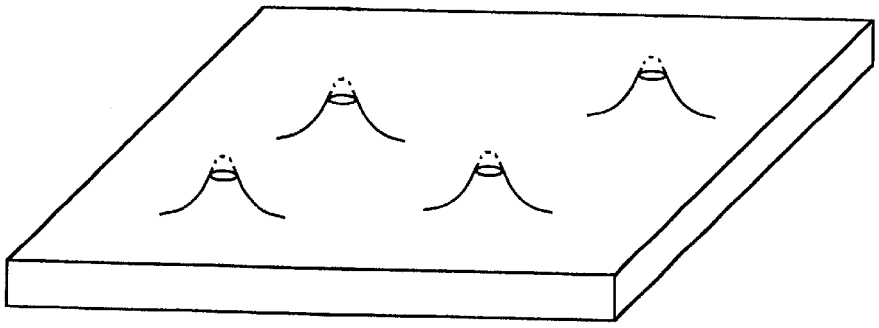

The top end portion of a projection is subjected to a higher pressure than other portions, and, further, since the surface of a paper sheet representing a primary record medium is rough, the projection may wear depending on the material used therefor. FIGS. 7(*a*) and 7(*b*) are diagrams showing the volume by which the projection is reduced when the projection top end has been worn. In accordance with the present invention, since the paper sheet separation property is ensured by means of the projections provided on the surface of the transfer drum, the existence of the projections on the surface is important to the life time of the device. Of course, it is preferable to form the projections from a material having a limited wear property. However, with regard to the material used for the image forming device of the present embodiment, such wear is unavoidable. In order to protect the projection against such wear for the expected life time of the device, in the image forming device of the present embodiment, it has been determined that the total volume of the projection portions above the height more than 20 $\mu$m should be larger than the possible total wear volume determined by multiplying the volume of wear per one paper sheet by the number of passing papers in the life time of the device. More specifically, with the projection material used in the present embodiment, the wear volume per one paper sheet is 0.4 $\mu$m$^3$/mm$^2$ and the number of passing papers during the expected life time of the device is defined as 240,000, so that the necessary volume of projection portions above the height more than 20 $\mu$m is 100,000 $\mu$m$^3$/mm$^2$. When estimating the volume of the projection portions above the height more than 20 $\mu$m in the present embodiment, while assuming the average height of the projections formed on the surface of the transfer drum 6 is 40 $\mu$m, the volume of the projection portions above the height more than 20 $\mu$m is about 1000 $\mu$m$^3$, while assuming that the portion has a gentle arcuate shape; therefore, by providing such projections in a number of about 10–250/mm$^2$, the required volume of 100,000 $\mu$m$^3$/mm$^2$ is ensured.

Now, in the image forming device of the present embodiment, the transfer device 12 is a transfer roller having a roller shape with a surface which is covered by an elastic body that causes close contact between the paper sheet and the transfer drum 6 by applying a force thereto. The image forming device uses a transfer method in which a bias of opposite polarity with regard to the toner is applied to the transfer roller, so that the toner is electrostatically transferred to the paper sheet. With the transfer drum 6 of the present invention, since projections are provided on the surface thereof, it is difficult to transfer the toner onto the paper sheet. However, like the present embodiment, the paper sheet is brought into close contact with the transfer drum by applying mechanical force thereto using the transfer roller, so that a desirable transfer can be performed.

Further, in the transfer drum 6 of the present invention, since projections are provided on the surface thereof, it is difficult to clean the toner that remains on the surface of the transfer drum 6. Therefore, in the image forming device as shown in FIG. 1, as the intermediate transfer body cleaning device 16, a cleaning means is provided in which the toner on the surface of the transfer drum 6 is removed using a rotating brush roller formed by providing a hair brush around the outer circumference of a cylindrical metallic shaft. With a cleaning means of this type, since the cleaning is performed by bringing the hair brush directly in contact with the transfer drum 6, toner caught between the projections can be easily, which is effective to maintain a high picture image quality.

Now, a method of forming minute projections having a height less than 60 $\mu$m on the surface of the transfer drum will be explained.

Figure 2A:
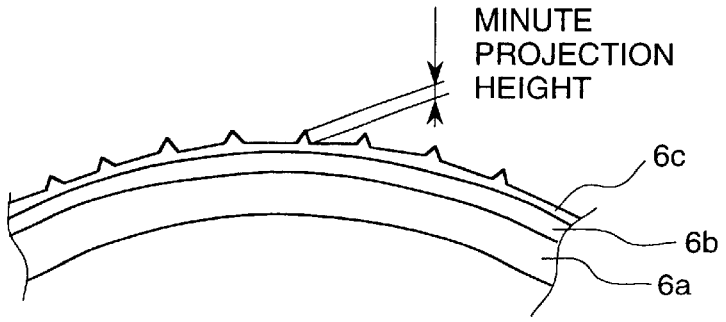
FIGS. 2(*a*) and 2(*b*) are partial enlarged cross sectional views of a transfer drum according to an embodiment of the present invention.
Figure 2B:
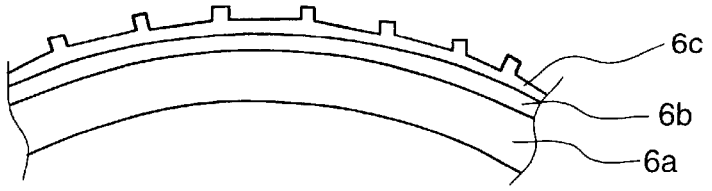

In the embodiment shown in FIGS. 2(A) and 2(B), the toner releasing layer on the surface is formed by a spray coating. When performing the spray coating process, it has been found that, for a coating condition in which the surface has a tendency to be dry, a so-called dry spray is used, so that projections having a desired configuration are formed. The coating material used in the present embodiment is an aqua series dispersion type latex blending fluoro resin and fluoro rubber, selected from the view point of toner releasability; however, the coating material is not limited to the one used in the present embodiment in order to form projections having desired configurations. Namely, it is possible to form projections having a desired configuration by use of a coating material having a different resin series and different blending components, or by using a different medium, such as an organic solvent, and the present inventors have confirmed that the size of the projections on the surface formed by the alternative coating materials can also be controlled. The discovery that the surface configuration (projections) can be controlled by the coating condition is quite useful, since an intermediate transfer body having any desired film thickness with high accuracy can be manufactured by the spray coating, thereby, an extremely inexpensive transfer drum with an excellent performance can be manufactured.

Figure 8:
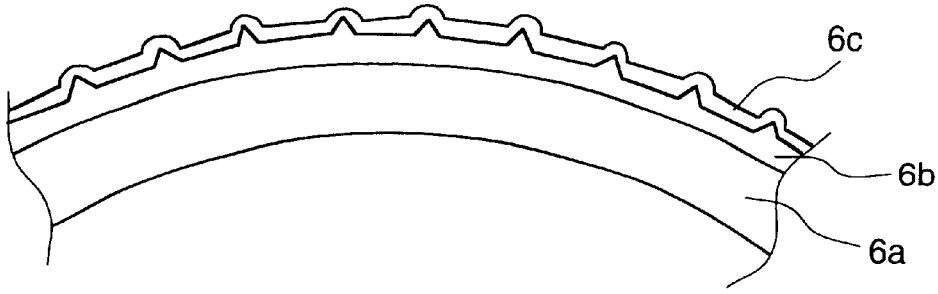
FIG. 8 is a partial enlarged cross sectional view of a transfer drum according to an embodiment of the present invention.

Further, in accordance with another embodiment, as shown in FIG. 8, a desired unevenness is formed on the surface of an elastic layer serving as a backing layer with respect to a surface layer, and the surface layer serving a toner releasing layer is formed thereon. As a method of providing an unevenness on the backing elastic layer, the unevenness is provided on the surface of a mold when molding a rubber serving as the backing layer, and the unevenness is formed during the molding process of the rubber. Alternatively, it is possible to form a desired unevenness through a post processing such as polishing, after rubber molding. It is, of course, possible while providing such unevenness on the backing elastic layer, in parallel therewith and in addition thereto, to form projections having desired configurations through the previous surface layer formation with the spray coating.

Figure 9:
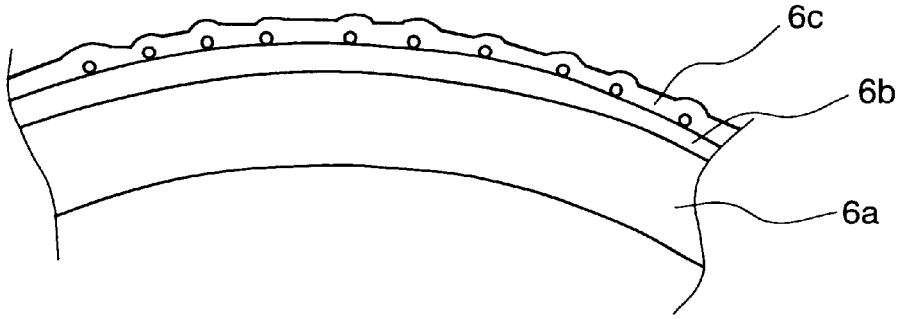
FIG. 9 is a partial enlarged cross sectional view of a transfer drum according to an embodiment of the present invention.

Further, in still another embodiment as shown in FIG. 9, through the mixing of grains having a variety of configurations into the material forming the surface layer, a desired unevenness can be formed. In this instance, the transfer drum can be manufactured in such a manner that the variety of grains are deposited on the backing surface in advance, and, thereafter, the surface layer is formed thereon. Since the grains are microscopic, any material can be used; however, in order to prevent charging-up of the surface layer, it is preferable to use a semiconductor or conductor having a volume specific resistance less than $10^{12}$ $\Omega\cdot$cm. As such materials, carbon powder, glass beads formed by processing the metallic powder surface, conductive and resin powder formed by dispersing a conductive member, such as carbon powder, can be used. Further, other than the powders of resin and rubber, inorganic pigment powders, such as red iron oxide, inorganic powders, such as calcium carbonate, talc, mica and powders of metallic oxide, which are preferable to form a desired unevenness may be used, although their conductivity is low. Further, mixtures thereof can be used.

Figure 10:
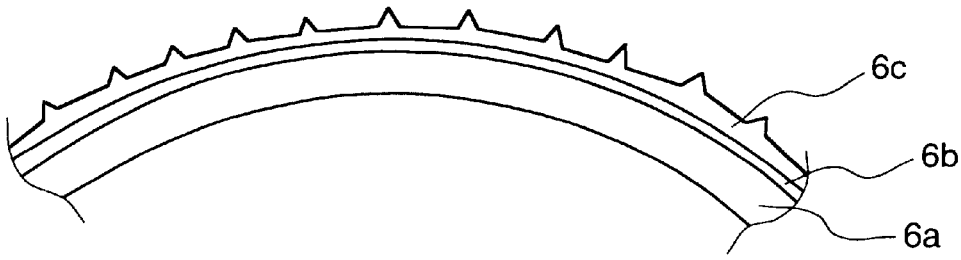
FIG. 10 is a partial enlarged cross sectional view of a transfer drum according to an embodiment of the present invention.

Still further, in still another embodiment as shown in FIG. 10, after forming large projections having a height more than 60 $\mu$m, the upper portions of the projections are polished by a polishing device or are ground to reduce the height thereof to less than 60 $\mu$m. In the present embodiment, since the projection height can be surely processed to any desired height less than 60 $\mu$m, a drum surface with no projections having a height more than 60 $\mu$m can be obtained. Thereby, an advantage is achieved in that a transfer drum with less image defects can be manufactured. It is preferable to form the surface layer having minute projections or projections in such a manner that after forming minute grains or projections having a height less than 80 $\mu$m, the surface layer is formed by coating the same. In the embodiments explained hitherto, drum-shaped intermediate transfer bodies have been employed; however, the present invention is not limited to use of the drum-shaped intermediate transfer bodies. For example, a belt-shaped intermediate transfer body can be used. Further, the present invention can be applied to a member which requires a paper sheet separation property, such as a paper sheet delivering roller.

As has been explained hitherto, through the provision of minute projections having a height of more than 20 $\mu$m and less than 60 $\mu$m (preferably, less than 40 $\mu$m) on the surface of the intermediate transfer body, an intermediate transfer body which produces a stable and desired picture image quality and permits easy separation of a record medium, such as thin paper whose which separation is difficult, can be manufactured with a low cost, and an image forming device with a higher performance can be provided which maintains a stable picture image quality level and accommodates a variety of paper sheets.

According to the present invention, with a simple constitution, an intermediate transfer body which produces a stable and desired picture image quality with no image defects, such as white speckles, and permits easy separation of a record medium, such as thin paper for which separation is difficult, can be manufactured with a low cost; and, an image forming device with a high performance and a low cost can be provided which maintains a stable picture image quality level and accommodates a variety of types of paper sheets.

What is claimed is:

1. An electrophotographic image forming device which comprises a photosensitive body, an exposure means which forms an electrostatic latent image on the photosensitive body, a developing means which develops the electrostatic latent image in different colors to form toner images, an intermediate transfer body onto which the developed toner images of different colors are transferred in an overlapping manner, a transfer means which transfers the image on the intermediate transfer body on a record medium and a fixing means which fixes the image on the record medium, and the record medium being separated from the transfer means by means of decharging, characterized in that projections having a height of more than 20 $\mu$m and less than 60 $\mu$m are provided on a surface of the intermediate transfer body, the projection height of more than 90% of the projections is less than 60 $\mu$m, the projection height of more than 30% of the projections is more than 20 $\mu$m and a part of the more than 30% of the projections includes projections having a height of more than 30 $\mu$m.

2. An electrophotographic image forming device comprises a photosensitive body, an exposure means which forms an electrostatic latent image on the photosensitive body, a developing means which develops the electrostatic latent image in different colors to form toner images, an intermediate transfer body onto which the developed toner images of different colors are transferred in an overlapping manner, a transfer means which transfers the image on the intermediate transfer body on a record medium and a fixing means which fixes the image on the record medium, characterized in that projections having a height of more than 20 μm and less than 60 μm are provided on a surface of the intermediate transfer body, wherein the projections are provided in a number of 1–25,000/cm$^2$.

3. An electrophotographic image forming device of claim 2, wherein a radius of curvature of the intermediate transfer body at the portion where the record medium is transferred is more than 67 mm.

4. An electrophotographic image forming device of claim 2, wherein an outer diameter of the intermediate transfer body is more than 134 mm.

5. An electrophotographic image forming device of claim 2, wherein a width of the intermediate transfer body is more than 290 mm.

6. A electrophotographic image forming device of claim 2, wherein a printing precondition of the electrophotographic image forming device is for a paper of 62 g/m$^2$.

7. An electrophotographic image forming device of claim 3, wherein the projections having a height of more than 20 μm and less than 60 μm formed on the surface of the intermediate transfer body are formed by a material having rubber elasticity.

8. An electrophotographic image forming device of claim 3, wherein a surface layer having minute projections or the projections having a height of more than 20 μm and less than 60 μm formed on the surface of the intermediate transfer body is formed by coating.

9. An electrophotographic image forming device of claim 8, wherein components of the surface layer formed by the coating are constituted at least by a mixture component containing fluoro rubber and fluoro resin.

10. An electrophotographic image forming device of claim 3, wherein a surface layer having minute projections or the projections having a height of more than 20 μm and less than 60 μm formed on the surface of the intermediate transfer body is formed by coating after forming minute grains or projections having a height less than 80 μm.

11. An electrophotographic image forming device of claim 2, wherein the height of the projections is regulated less than 60 μm by at least one of polishing, rubbing and grinding of a surface layer.

12. An electrophotographic image forming device of claim 2, wherein the intermediate transfer body includes one or a plurality of elastic layers and the projections having a height of more than 20 μm and less than 60 μm are provided on the surface of the elastic layer.

13. An electrophotographic image forming device of claim 2, wherein an area of top end portions of the projections which contacts to the record medium is less than 0.04 mm$^2$.

14. An electrophotographic image forming device of claim 2, wherein an area of the portions of the projections which contacts to a paper sheet is more than 1% and less than 50% of the total area.

15. An electrophotographic image forming of claim 2, wherein a volume of portions above a height more than 20 μm of the projections is more than 100,000 μm$^3$/mm$^2$.

16. An electrophotographic image forming device of claim 2, wherein the projections are formed on a surface of an elastic body.

17. An electrophotographic image forming device of claim 2, wherein the projections are formed on an uneven surface lower than a maximum height of the projections.

18. An electrophotographic image forming device of claim 2, wherein the projections are formed by the same material as a surface layer of the intermediate transfer body.

19. An electrophotographic image forming device claim 2, wherein the intermediate transfer body is a drum shape.

20. An electrophotographic image forming device of claim 19, further comprising a separation means in which the record medium is separated by reducing electric charge at a back face of the record medium.

21. An electrophotographic image forming device of claim 2, further comprising a cleaning means for cleaning toners on the surface of the intermediate transfer body, and the cleaning means is a brush cleaner.

22. An electrophotographic image forming device of claim 2, wherein the transfer means includes a mechanism which presses the record medium toward the intermediate transfer body.

23. An electrophotographic image forming device of claim 2, wherein the projection height of more than 90% of the projections is less than 60 μm, and the projection height of more than 30% of the projections is more than 20 μm.

24. An electrophotographic image forming device which comprises a photosensitive body, an exposure means which forms an electrostatic latent image on the photosensitive body, a developing means which develops the electrostatic latent image in different colors to form toner images, an intermediate transfer body onto which the developed toner images of different colors are transferred in an overlapping manner, a transfer means which transfers the image on the intermediate transfer body on a record medium and a fixing means which fixes the image on the record medium, and the record medium being separated from the transfer means by means of decharging, characterized in that an outer diameter of the intermediate transfer body is more than 420 mm or the length in an axial direction of the intermediate transfer body is more than 290 mm and projections are provided on a surface of the intermediate transfer body, more than 90% of the projections having a projection height which is less than 60 μm, the projection height of more than 30% of the projections is more than 20 μm and a part of the more than 30% of the projections includes projections having a height of more than 30 μm.

25. An electrophotographic image forming device which comprises a photosensitive body, an exposure means which forms an electrostatic latent image on the photosensitive body, a developing means which develops the electrostatic latent image in different colors to form toner images, an intermediate transfer body onto which the developed toner images of different colors are transferred in an overlapping manner, a transfer means which transfers the image on the intermediate transfer body on a record medium and a fixing means which fixes the image on the record medium, characterized in that projections having a height of more than 20 μm and less than 60 μm are provided on a surface of the intermediate transfer body, wherein an average projection height of the projections having a height more than 20 μm is in a range of 20 μm–40 μm.

26. An intermediate transfer body for color use which transfers a latent image to a record medium as well as is separated from the record medium by decharging, characterized in that an outer diameter of the intermediate transfer body is set more than 290 mm, projections having a height of more than 20 μm and less than 60 μm are provided on a surface of the intermediate transfer body, more than 90% of the projections have a projection height which is less than 60 μm, the projection height of more than 30% of the projections is more than 20 μm and a part of the more than 30% of the projections includes projections having a height of more than 30 μm.

27. An electrophotographic image forming method in which an electrostatic latent image is formed on a photosensitive body, the electrostatic latent image is developed in different colors to form toner images, the developed toner images of different colors are transferred onto an intermediate transfer body in an overlapping manner, the image on the intermediate transfer body is transferred onto a record medium, the record medium is separated from a transfer means by decharging and the image on the record medium is fixed, characterized in that an outer diameter of the intermediate transfer body is set more than 290 mm, projections having a height of more than 20 μm and less than 60 μm are provided on a surface of the intermediate transfer body, the projection height of more than 90% of the projections is less than 60 μm, and the projection height of more than 30% of the projections is more than 20 μm.

* * * * *